United States Patent [19]

Miller

[11] Patent Number: 4,763,677

[45] Date of Patent: Aug. 16, 1988

[54] SONIC TREATMENT APPARATUS

[75] Inventor: George R. Miller, McHenry, Ill.

[73] Assignee: Techalloy Illinois, Inc., Union, Ill.

[21] Appl. No.: 935,345

[22] Filed: Nov. 26, 1986

[51] Int. Cl.[4] ..... B08B 3/121

[52] U.S. Cl. ..... 134/105; 134/1; 134/122 R; 134/184

[58] Field of Search ..... 134/1, 105, 107, 122 R, 134/184; 68/3 SS; 366/127

[56] References Cited

U.S. PATENT DOCUMENTS

| | | | |
|---|---|---|---|
| 2,650,872 | 9/1953 | Goldwasser | 68/3 SS X |
| 2,673,811 | 3/1954 | Tsunoda | 366/127 X |
| 2,828,231 | 3/1958 | Henry | 68/3 SS X |
| 2,937,292 | 5/1960 | Welkowitz et al. | 68/3 SS X |
| 3,066,084 | 11/1962 | Osterman, Jr. et al. | 134/1 X |
| 3,425,951 | 2/1969 | Ishiwata | 366/127 X |
| 3,517,674 | 6/1970 | Allen et al. | 68/3 SS X |

FOREIGN PATENT DOCUMENTS

| | | | |
|---|---|---|---|
| 824538 | 12/1959 | United Kingdom | 134/1 |
| 966521 | 8/1964 | United Kingdom | 134/1 |

*Primary Examiner*—Philip R. Coe

*Attorney, Agent, or Firm*—Leydig, Voit & Mayer

[57] ABSTRACT

Ultrasonic wire cleaning apparatus in which elongated strands of wire are advanced continuously through a bath of acid contained in a tank. Ultrasonic transducers are located in the tank and produce ultrasonic energy which coacts with the acid to effect cleaning of the wire. The transducers are submerged in and are cooled by a separate bath of water located in the tank beneath the acid and are protected against erosion by a rigid plastic plate which separates the acid from the water. Water-filled chambers at the sides of the tank keep the head of the water bath greater than the head of the acid bath in order to prevent the acid from leaking downwardly into the water and contacting the transducers.

8 Claims, 2 Drawing Sheets

SONIC TREATMENT APPARATUS

BACKGROUND OF THE INVENTION

This invention relates generally to sonic apparatus for treating material and, more particularly, to ultrasonic cleaning apparatus for removing contaminants from continuously advancing lengths of wire or other elongated material.

In conventional commercially used ultrasonic wire cleaning apparatus, several ultrasonic generators or transducers are submerged in a bath of acid which is contained in an open-topped tank. Several spaced strands of wire are advanced continuously through the acid bath and, during such advance, the ultrasonic energy produced by the transducers coacts with the acid to clean contaminants from the wire. The acid also serves to dissipate heat from the transducers.

In such conventional apparatus, the ultrasonic energy strikes air above the open tank and is reflected back to the acid bath and the transducers. As a result of being submerged in the acid and being subjected to the reflected energy, the transducers erode rather severely and must be replaced at relatively frequent intervals.

Jubenville et al U.S. Pat. No. 4,167,424 discloses ultrasonic cleaning apparatus in which several ultrasonic transducers are housed in individual, water-filled receptacles at the top of the tank. While the receptacles tend to protect the transducers against erosion, the arrangement is relatively complex and expensive and requires that the top of the tank be closed. Thus, it is difficult to service the tank and to initially thread the elongated material therethrough.

SUMMARY OF THE INVENTION

The general aim of the present invention is to provide new and improved ultrasonic material treatment apparatus which is of relatively simple construction and which protects the ultrasonic transducers against erosion while leaving the top of the treatment tank open for easy servicing and repair and for easy inspection of and accessibility to the elongated material passing through the tank.

A more detailed object of the invention is to achieve the foregoing by providing ultrasonic treatment apparatus having an open-topped tank and having a unique partition which divides the tank into upper and lower compartments. The ultrasonic transducers are submerged in water or other cooling liquid in the lower compartment and are isolated by the partition from the treatment solution in the upper compartment. The partition is made of a material which transmits ultrasonic energy from the transducers to the treatment solution and the elongated material being advanced therethrough but which protects the transducers against being eroded by acid and reflected sonic waves.

Another object of the invention is to provide an ultrasonic treatment tank which is uniquely constructed to constantly keep a lower bath of cooling liquid full and to prevent an upper bath of treatment solution from draining into the lower bath of cooling liquid and damaging the transducers therein even though the partition separating the two baths might develop a leak.

The invention also resides in the novel construction of the tank to eliminate air bubbles in the cooling bath and thereby prevent such bubbles from interfering with the efficiency of the ultrasonic transducers.

These and other objects and advantages of the invention will become more apparent from the following detailed description when taken in conjunction with the accompanying drawings.

DETAILED DESCRIPTION OF THE PREFERRED EMBODIMENT

Figure 3:
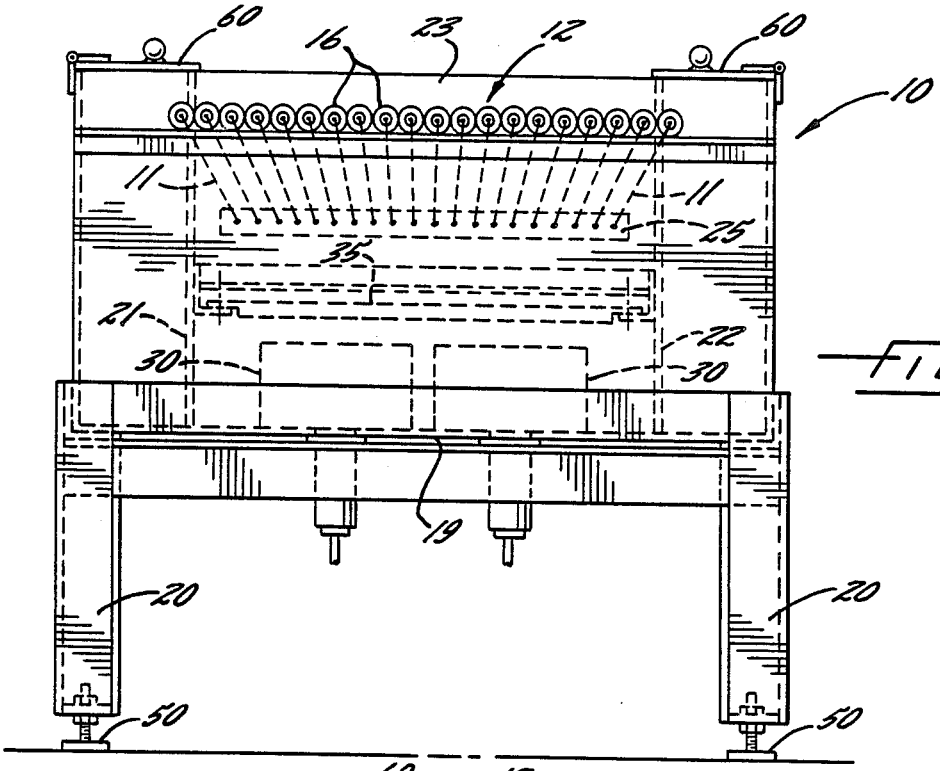
FIG. 3 is an enlarged end elevational view of the apparatus as taken along the line 3—3 of FIG. 1.

As shown in the drawings for purposes of illustration, the invention is embodied in apparatus 10 for treating, and specifically for cleaning, elongated material which herein has been shown as being in the form of several laterally spaced strands 11 of steel wire. Conventional means (not shown) are provided for continuously advancing the wire 11 through the cleaning apparatus 10. Prior to being fed to the cleaning apparatus, the wire may be coated with soap, drawing lubricants and the like resulting from a wire drawing operation. After being cleaned, the wire is supplied to an annealing furnace (not shown).

Figure 4:
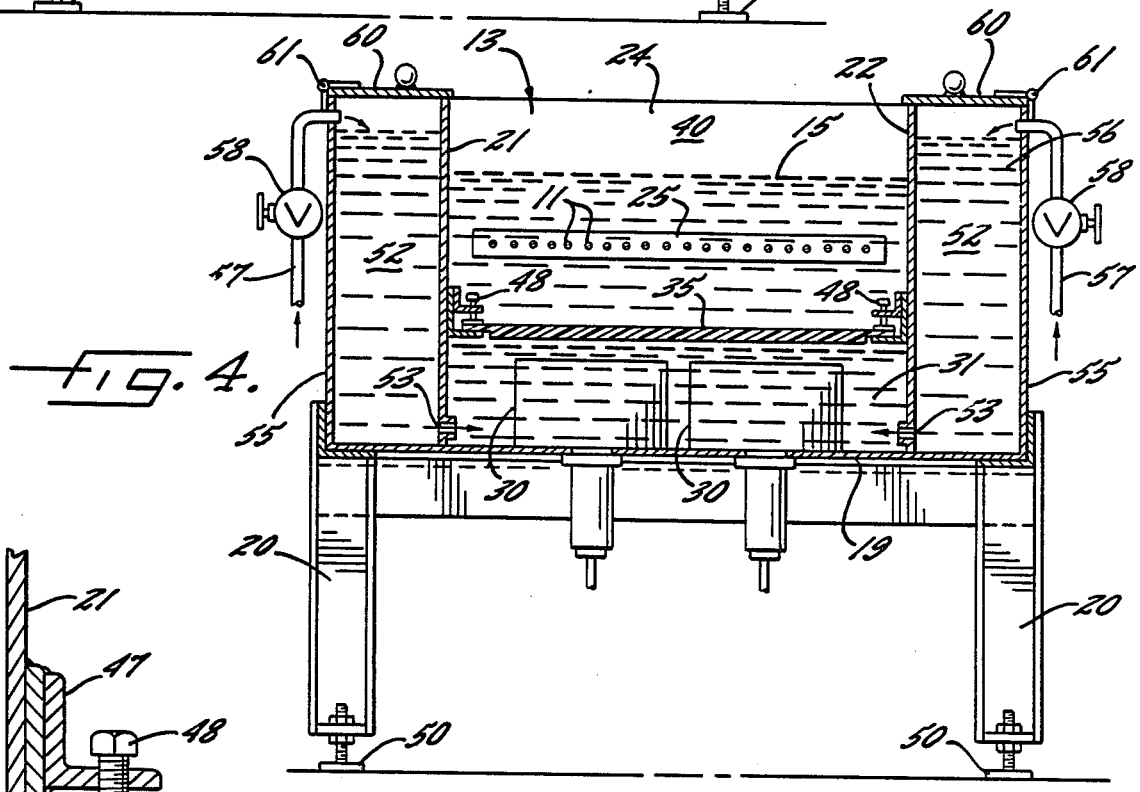
FIG. 4 is an enlarged cross-section taken substantially along the line 4—4 of FIG. 1.
Figure 1:
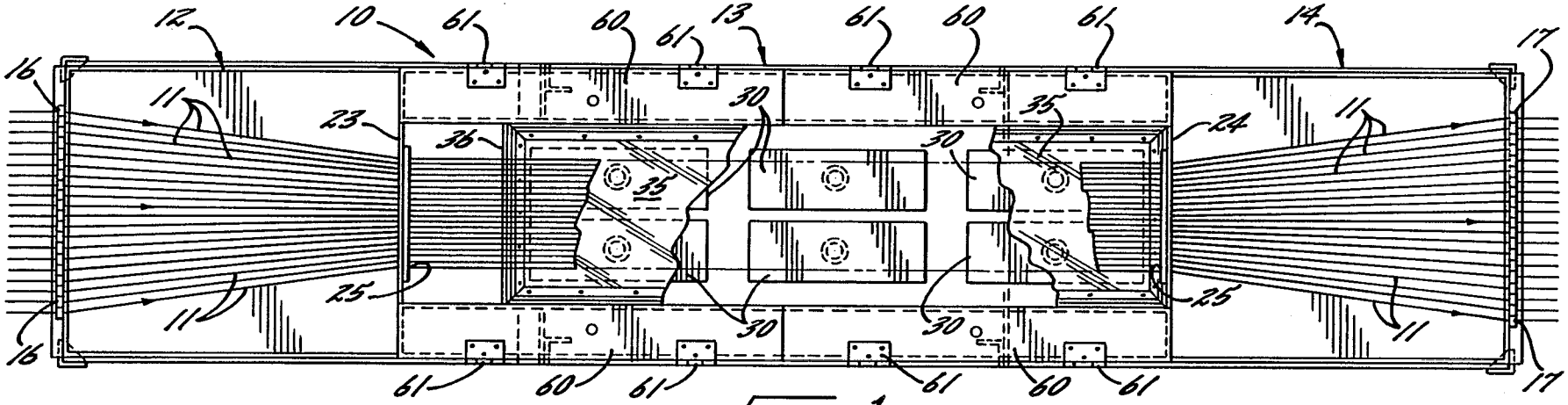
FIG. 1 is a top plan view of ultrasonic treatment apparatus incorporating the unique features of the present invention.

In the present instance, the cleaning apparatus 10 comprises an upstream tank 12, an intermediate tank 13 and a downstream tank 14. The three tanks are disposed end-to-end and each contains a bath 15 (FIGS. 2 and 4) of difluophosphroic acid or other suitable treating solution for cleaning the wire 11. The wire is guided through eyes 16 (FIG. 3) at the upstream end of the upstream tank, passes through the intermediate tank and then is guided through eyes 17 (FIGS. 1 and 2) at the downstream end of the downstream tank. Primary cleaning of the wire is effected in the intermediate tank 13 as a result of ultrasonic energy coacting with the acid 15 in that tank. The upstream tank 12 serves as a preliminary soak tank while the downstream tank 14 serves as a final rinse tank. Acid may be extracted from the downstream tank 14, filtered and then resupplied to the upstream tank 12 by a closed loop pumping and filtering system (not shown). By supplying the acid to the upstream tank 12 and exhausting the acid from the downstream tank 14, the acid in the primary cleaning tank 13 remains in a relatively non-turbulent state so as to avoid a reduction in the efficiency of the ultrasonic cleaning in the primary tank.

The tanks 12, 13 and 14 all are open at their tops and include a generally horizontal bottom wall 19 (FIG. 2) which is supported by a series of depending legs 20. The upstream and downstream tanks 12 and 14 are of conventional construction while the primary cleaning tank 13 includes a pair of opposing vertical side walls 21 and 22 (FIG. 4) which are spaced some distance inwardly from the side margins of the bottom wall 19. Opposing upstream and downstream end walls 23 and 24 (FIG. 2) of the main tank 13 extend between the side walls 21 and 22 and support apertured bars 25 (FIG. 4) which guide the wire 11 as the latter advances through the main tank. The end walls 23 and 24 are constructed to allow acid to flow from the upstream tank 12 through the main tank 13 and to the downstream tank 14 and also act as baffles to reduce turbulence in the main tank.

Supported within the main tank 13 on the bottom wall 19 thereof is a series (herein, six) of ultrasonic transducers 30. When electrically energized from an electrical generator (not shown) of suitable frequency, the transducers produce high frequency sonic energy which interacts with the acid 15 to effect thorough cleaning of the wire 11 in the main tank. O'Neill U.S. Pat. No. 3,066,686 discloses ultrasonic transducers of the same general type as may be used with the present cleaning apparatus 10.

Herein, the six transducers 30 are spaced laterally and longitudinally from one another in the main tank 13 and are arranged in two laterally spaced rows each containing three transducers. When energized, the transducers generate considerable heat and must be surrounded by a liquid for dissipating the heat and cooling the transducers.

In accordance with the primary aspect of the present invention, the transducers 30 are submerged in a bath 31 (FIG. 4) of water or other inert cooling liquid in the lower portion of the tank 13 and are isolated from attack by the acid 15 in the upper portion of the tank and by sonic waves which strike the air above the tank and reflect downwardly into the tank. As a result, the transducers are shielded against erosion and thus experience a comparatively long service life without need of frequent repair or replacement. At the same time, the top of the tank 13 is left open to enable easy threading of the wire 11 through the tank and to enable inspection of the wire as it is being cleaned.

Figure 2:
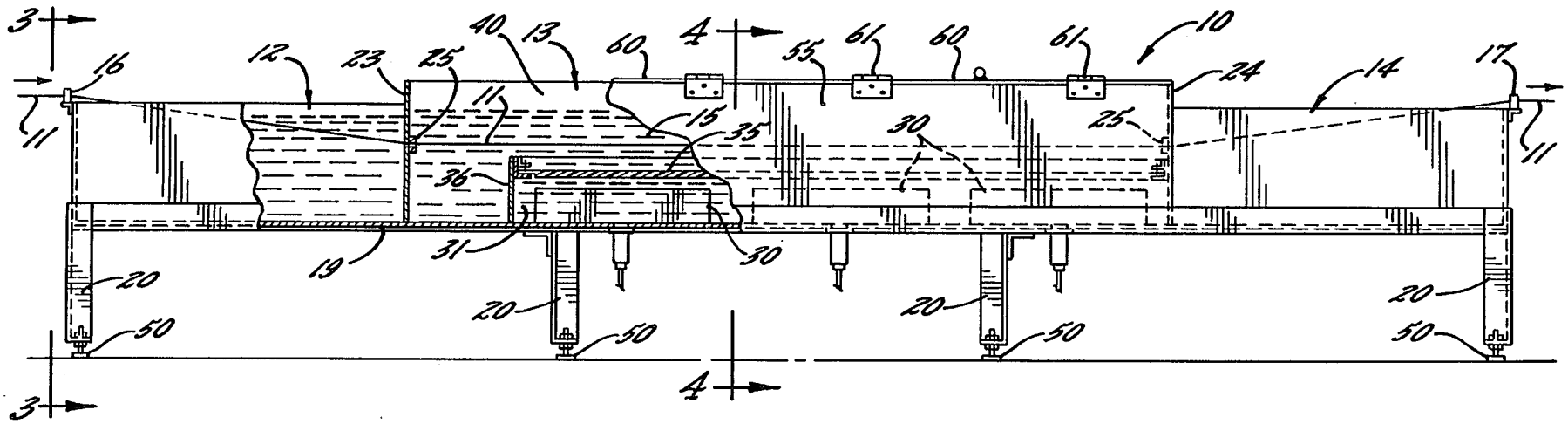
FIG. 2 is a side elevational view of the apparatus shown in FIG. 1, certain parts being broken away and shown in section.

To achieve the foregoing, the transducers 30 are covered by a partition 35 (FIG. 4) which is capable of transmitting the ultrasonic energy generated by the transducers 30 and which is resistant to the acid 15. In this particular instance, the partition is a horizontal plate made of rigid translucent plastic such as that sold under the trade designator "Lexan". The plate 35 is approximately ¾" thick, is spaced abut 2" above the transducers and extends between the side walls 21 and 22 of the main tank 13. The plate 35 completely overlies the transducers 30 and the spaces therebetween and extends to and is supported from the downstream end wall 24 of the main tank 13. In the present instance, however, the upstream end of the plate 35 stops short of the upstream end wall 23 of the tank 13 as shown in FIG. 2 and is supported by an upright wall 36 extending upwardly from the bottom wall 19 and extending between the side walls 21 and 22. The wall 36 serves as a baffle to help reduce turbulence in the main tank 13.

With the foregoing arrangement, the "Lexan" plate 35 divides the main tank 13 into an upper compartment 40 (FIG. 4) containing the acid 15 and a lower compartment 41 containing cooling water 31, the lower compartment being closed at its upstream end by the wall 36. By virtue of the plate, the transducers 30 are protected from the acid 15 but, at the same time, are cooled by the water 31. In addition, the plate absorbs sonic energy reflected downwardly by the air above the tank 13. Accordingly, the transducers are not subjected to being eroded and thus experience a relatively long service life. It is believed that the translucent plate also tends to diffuse the downwardly reflected sonic energy and cause such energy to spread over the gaps or spaces between the transducers so as to help prevent erosion of the transducers.

It is important to maintain a solid mass of water 31 in the lower compartment 41 of the tank 13 and to keep the compartment free of air bubbles. Ultrasonic energy does not pass readily through air and thus the existance of air bubbles in the lower compartment could result in erosion of the transducers 30.

Figure 5:
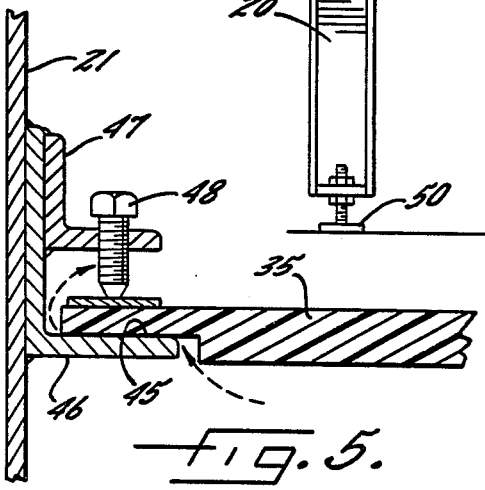
FIG. 5 is an enlarged fragmentary view of certain parts shown in FIG. 4.

In order to eliminate air bubbles from the lower compartment 41, the side margins of the plate 35 are attached to the side walls 21 and 22 of the tank 13 in such a manner as to create an escape path for air. As shown in FIG. 5, the lower surface of each side margin of the plate 35 is relieved as indicated at 45 and rests on the horizontal leg of an angle iron 46 which is welded to the adjacent side wall. A second angle iron 47 is welded to the angle iron 46 in upwardly spaced relation to the plate 35 and supports a plurality of clamping screws 48. When the screws 48 are tightened, they clamp the plate 35 against the angle iron 46 but not so tightly as to establish a fluid-tight seal between the two. Thus, any air in the lower compartment 41 may vent between the plate 35 and the horizontal leg of the angle iron 46 and into the upper compartment 40 via the path shown generally by the dotted arrows in FIG. 5. To promote the escape of air, the legs 20 of the tank 13 are equipped with vertically adjustable feet or levelors 50 (FIG. 4) which are adjusted so as to tilt the tank 13 slightly about its longitudinal axis and thereby tilt the bottom wall 19 and the plate 35 out of true horizontal planes. As a result of such tilting, any air in the lower compartment 41 is forced toward the higher side of the plate 35 for escape past the adjacent side margin of the plate.

Means are provided for keeping the lower compartment 41 filled with water and for insuring that no acid 15 seeps downwardly from the upper compartment 40 into the lower compartment and into contact with the transducers 30 therein. Herein, these means are formed by at least one and preferably two chambers 52 (FIG. 4) located adjacent the side walls 21 and 22 of the tank 13 and communicating with the lower compartment 41 via passages 53 in the lower end portion of the side walls. The chambers 52 are defined by outer jackets 55 located adjacent the side walls 21 and 22 and are filled with water 56 which rises to a level significantly higher than the level of the acid 15 in the upper compartment 40. Accordingly, the water 56 in the chambers 52 keeps the lower compartment 41 full and creates a pressure head which is significantly higher than the head created by the acid 15. If leaks develop between the upper and lower compartments 40 and 41, the head of the water prevents acid from draining downwardly into contact with the transducers 30 and causes water to flow harmlessly into the upper compartment.

The chambers 52 are connected to water lines 57 (FIG. 4) which are equipped with valves 58. The valves may be controlled by floats (not shown) which cause the valves to open automatically if the level of the water 56 in the chambers 52 falls below a predetermined elevation. To permit inspection of the water in the chambers, the jackets 55 include top covers 60 which may be swung to open positions about hinges 61.

From the foregoing, it will be apparent that the present invention brings to the art new and improved ultrasonic wire cleaning apparatus 10 in which the transducers 30 are protected against erosion by virtue of the transducers being submerged in a separate bath 31 of cooling water and shielded from the acid 15 by the Lexan plate 35. The apparatus 10 is relatively simple and inexpensive in construction and permits the top of the tank 13 to remain open so as to facilitate inspection of the wire 11 during the cleaning operation and to facilitate both initial threading of the wire and re-threading of the wire if a strand should happen to break upstream of or within the tank. The chambers 52 insure that the lower compartment 41 which houses the transducers 30 remains filled with water 31 at all times and prevent acid 15 from leaking into the lower compartment.

I claim:

1. Sonic apparatus for treating material and comprising a tank having a bottom wall and upright side wall means, partition means dividing at least a portion of said tank into upper and lower compartments, a treating liquid in said upper compartment, electrically energizable transducer means in said lower compartment and operable when energized to produce sonic energy which coacts with said treating liquid to treat material in said upper compartment, a cooling liquid in said lower compartment, said cooling liquid being different from said treating liquid, being inert with respect to said transducer means and serving to cool said transducer means when the latter are energized, said partition means including a generally horizontal wall for isolating said treating liquid from said cooling liquid and said transducer means and made of a material enabling sonic energy to be transmitted through said wall from said transducer means to said treating liquid and to said material in said upper compartment, said tank further including a chamber containing cooling liquid and communicating with said lower compartment, the level of cooling liquid in said chamber being higher than the level of treating liquid in said upper compartment whereby the cooling liquid in said chamber keeps said lower compartment full and creates a pressure head preventing treating liquid in said upper compartment from leaking into said lower compartment.

2. Sonic apparatus as defined in claim 1 in which said generally horizontal wall comprises a plate made of rigid translucent plastic.

3. Sonic apparatus as defined in claim 2 in which said transducer means comprises at least three ultrasonic transducers spaced from one another in said lower compartment, said plate overlying said transducers and the spaces therebetween.

4. Ultrasonic apparatus for cleaning elongated strands of metal wire, said apparatus comprising a tank having a bottom wall, opposing upright side walls and opposing upright end walls, partition means in said tank and dividing at least a portion of said tank into upper and lower compartments, said wire strands being fed continuously between said end walls and through said upper compartment, a bath of acid in said upper compartment, electrically energizable ultrasonic transducer means in said lower compartment and operable when energized to produce ultrasonic energy which coacts with said acid to clean the wire strands passing through said upper compartment, a bath of cooling liquid in said lower compartment, said cooling liquid being different from said acid, being inert with respect to said transducer means, and serving to cool said transducer means when the latter are energized, said partition means comprising a generally horizontal plate for isolating said acid from said cooling liquid and said transducer means, said plate being made of an acid-resistant plastic capable of transmitting ultrasonic energy from said transducer means to said acid, said tank further including a chamber containing cooling liquid and communicating with said lower compartment, the level of cooling liquid in said chamber being higher than the level of acid in said upper compartment whereby the cooling liquid in said chamber keeps said lower compartment full and creates a pressure head preventing acid in said upper compartment from leaking into said lower compartment.

5. Ultrasonic apparatus for cleaning elongated strands of metal wire, said apparatus comprising a tank having a bottom wall, opposing upright side walls, opposing upright end walls and an open top, partition means in said tank and dividing at least a portion of said tank into upper and lower compartments, said wire strands being advanced continuously between said end walls and through said upper compartment, a bath of acid in said upper compartment, at least three electrically energizable ultrasonic transducers spaced from one another in said lower compartment and operable when energized to produce ultrasonic energy which coacts with said acid to clean the wire strands advancing through said upper compartment, a bath of water in said lower compartment and serving to cool said transducers when the latter are energized, said partition means comprising a generally horizontal plate overlying said transducers and the spaces therebetween and isolating said acid from said water and said transducers, said plate being made of an acid-resistant and translucent plastic capable of transmitting ultrasonic energy from said transducers to said acid and said wire, said tank further including a chamber containing water and communicating with said lower compartment, the level of water in said chamber being higher than the level of acid in said upper compartment whereby the water in said chamber creates a pressure head preventing acid in said upper compartment from leaking into said lower compartment.

6. Ultrasonic apparatus as defined in claim 5 in which said lower compartment is completely filled with water, and means establishing communication between said upper and lower compartments to permit air bubbles in the water in said lower compartment to escape into said upper compartment.

7. Ultrasonic apparatus as defined in claim 6 in which said means for establishing communication between said upper and lower compartments is located adjacent one of said side walls of said tank, and adjustable means for causing the bottom wall of said tank to be located in a slightly tilted position relative to a horizontal plane so as to force air bubbles in said water toward said communication-establishing means.

8. Ultrasonic apparatus as defined in claim 7 in which said tank includes legs extending downwardly from the bottom wall of said tank, said adjustable means comprising vertically adjustable leveling feet attached to the lower ends of said legs.

* * * * *